US007922624B1

(12) United States Patent
Fairhurst et al.

(10) Patent No.: US 7,922,624 B1
(45) Date of Patent: Apr. 12, 2011

(54) MULTI-FUNCTION EXERCISE PLATFORM

(75) Inventors: Angela L. Fairhurst, Los Angeles, CA (US); Terry Simpson, Studio City, CA (US)

(73) Assignee: Fairhurst Productions, Inc., Los Angeles, CA (US)

( * ) Notice: Subject to any disclaimer, the term of this patent is extended or adjusted under 35 U.S.C. 154(b) by 0 days.

(21) Appl. No.: 11/786,857

(22) Filed: Apr. 12, 2007

Related U.S. Application Data

(60) Provisional application No. 60/791,633, filed on Apr. 12, 2006.

(51) Int. Cl.
*A63B 22/04* (2006.01)
*A63B 21/06* (2006.01)

(52) U.S. Cl. ..... 482/52; 482/94

(58) Field of Classification Search ..... 482/51–53, 482/74, 77, 79, 93, 94, 104, 108, 109, 121, 482/123, 126, 129, 130, 142; D21/671, 686; 446/75

See application file for complete search history.

(56) References Cited

U.S. PATENT DOCUMENTS 3,634,895 A * 1/1972 Childers ..... 5/420
4,431,185 A * 2/1984 Cisneros ..... 482/93
5,154,678 A * 10/1992 Adamczyk et al. ..... 482/52
5,162,028 A * 11/1992 Wilkinson ..... 482/52
5,290,210 A * 3/1994 Hand et al. ..... 482/51
5,651,753 A * 7/1997 Wilkinson ..... 482/52
5,690,586 A * 11/1997 Wilhelm ..... 482/49
5,697,870 A * 12/1997 Osborn ..... 482/52
5,709,634 A * 1/1998 Pointer ..... 482/105
5,820,533 A * 10/1998 Goldman ..... 482/124
5,853,352 A * 12/1998 Login ..... 482/26
D413,989 S * 9/1999 Dupont ..... D25/62
6,099,442 A * 8/2000 Krull ..... 482/107
6,132,338 A * 10/2000 Shifferaw ..... 482/30
6,406,409 B1 * 6/2002 Silver ..... 482/104
6,908,417 B2 * 6/2005 Jackson ..... 482/52
7,326,154 B2 * 2/2008 Foley ..... 482/105
2003/0109364 A1 * 6/2003 Weir ..... 482/142
2006/0040796 A1 * 2/2006 Holloway ..... 482/52

* cited by examiner

*Primary Examiner* — Loan Thanh
*Assistant Examiner* — Oren Ginsberg
(74) *Attorney, Agent, or Firm* — Haverstock & Owens LLP

(57) ABSTRACT

Exercise platforms are adapted for aiding a user in performing aerobic exercises, such as step aerobics, as well as resistance and weight exercises. The embodiments of the present invention include a deformable surface, and detachable weight modules that allow a user to perform weight exercises using the weight of the device. Further, the exercise platforms of the present invention are stackable to allow for cooperative use of multiple platforms at once to perform a variety of different exercises. In some embodiments of the present invention, a platform is packaged with at least two sets of weight modules having different weights, and at least one resistance device.

43 Claims, 14 Drawing Sheets

MULTI-FUNCTION EXERCISE PLATFORM

PRIORITY CLAIM

This application claims benefit of priority under 35 U.S.C. Section 119(e) of the U.S. Provisional Patent Application Ser. No. 60/791,633, filed Apr. 12, 2006 and entitled "Multi-function exercise platform," which is hereby incorporated by reference.

FIELD OF THE INVENTION

The invention relates generally to multi-functional exercise devices and more specifically to aerobics, core, weight and resistance devices.

BACKGROUND

Step Aerobics

Step aerobics are aerobics routines based on kinesthetic movements that involve stepping on to and off of a step or bench. Typically, benches provided for step aerobics are modular in construction, such that two identical benches can be stacked one on the other to form a single bench of double the height.

Resistance Exercises

Resistance exercise devices are common in physical therapy and training settings. They range from complicated home gyms, e.g. BowFlex™, to simple polymer bands used in physical therapy to provide muscle training through a full range of motion.

Hand Weights

Relatively light hand weights are common in aerobic exercise settings. The addition of weight to aerobic exercises promotes muscle tone and increases the intensity of aerobic exertion. Common hand weights are metal or latex-rubber coated metal.

Increasingly, popular training regimens combine body weight exercises with balance, coordination and external resistance exercises. These cross-training regimens focus on physical attributes, including flexibility, coordination, and certain muscles, that traditional training or aerobics exercises often ignore. To accomplish this goal, these regimens often incorporate principles from more esoteric, but increasingly popular, fitness disciplines, such as yoga or Pilates.

For example, core training focuses on stabilizing the spine by strengthening core muscles of the torso, particularly the transversus abdominis. These muscles play a key role in balance, coordination, and mobility. While yoga and similar practices strengthen these muscles, they don't promote aerobic fitness or non-core muscular toning and development as much as traditional aerobics or strength training. Hence, core training regimens seek to combine traditional and core-strengthening exercises into integrated exercise routines.

Unfortunately, to perform exercises combining step aerobics, resistance, and hand weights, a consumer must purchase multiple devices as outlined above. Further, most such devices provide instructions only for their use alone. Consumers must either purchase separate exercise literature instructing them on a routine combining the three exercise types, or devise one on his or her ("her") own.

BRIEF SUMMARY OF THE INVENTION

The present invention provides a multi-functional exercise device that provides for aerobic, weight, and resistance exercises. The embodiments of the present invention include exercise platforms adapted for aiding a user in performing aerobic and core exercises, such as step aerobics, as well as resistance and weight exercises. Preferably, the top surface of the platforms is a soft material, which provides less stability than a hard plastic surface to encourage balance and core stability. The embodiments of the present invention include resistance devices and detachable weight modules that allow a user to perform resistance exercises against her body weight, and weight exercises using the weight of the device. Further, the exercise platforms of the present invention are stackable to allow for cooperative use of multiple platforms at once to perform a variety of different exercises. In the preferred embodiment of the present invention, a platform is packaged with at least two sets of weight modules having different weights, and at least one resistance device.

For example, some embodiments relate to a step exercise device. One class of such devices consistent with embodiments of the present invention comprises a rigid housing and a platform surface. The rigid housing includes a platform-supporting structure. The platform surface formed of an elastomeric material configured to deform under body weight, and coupled to the platform-supporting structure of the first housing. Preferably, the rigid housing is formed of a substantially rigid material such as thermoplastic.

Some embodiments relate to sets of exercise steps. For example, an exercise system comprises a first exercise step and a second exercise step. The first exercise step includes a first housing and a first platform surface. The first housing includes a first platform-supporting structure, a first upper lip and a first lower lip. The first platform surface is formed of an elastomeric material configured to deform under body weight, and coupled to the first platform-supporting structure of the first housing.

Similarly, the second housing includes a second platform-supporting structure, a second upper lip and a second lower lip. The second platform surface is formed of an elastomeric material configured to deform under body weight, and coupled to the second platform-supporting structure of the second housing.

In this system, the first upper lip is configured to mate with the second lower lip, and the second upper lip is configured to mate with the first lower lip, such that the first exercise step is able to be stably stacked upon the second exercise step and the second exercise step is able to be stably stacked upon the first exercise step. Preferably, the first and second housings are formed of a substantially rigid material such as thermoplastic.

Some other embodiments relate to multi-function exercise devices. For example, consistent with the present invention, a multifunctional exercise device comprises a body, a platform surface and a weight module. The body includes a platform-supporting structure, a weight-retaining structure, and an accessory interface. The platform surface is formed of a material that deforms under body weight, providing substantially less stability when stood upon than would a hard surface. It is coupled to the platform-supporting structure of the body. The weight module (preferably there are at least two) is removably coupled to the weight-retaining structure of the body. Preferably, the body is formed of a substantially rigid material such as thermoplastic.

Additional embodiments relate to exercise systems that aids a user in performing a plurality of exercise movements. For example, an exercise system comprises an exercise platform, a first weight module set, a second weight module set, and a resistance device set.

The exercise platform includes a surface formed from a resilient foam material, an accessory interface, and two or more weight-module interface features. The first weight module set comprises two weight modules each having a first weight and is configured to be removably coupled to the exercise platform via the weight-module interface features. The second weight module set also comprises two weight modules each having a second weight and is also configured to be removably coupled to the exercise platform via the weight-module interface features. The first weight and the second weight are different. The resistance device set comprises a first resistance device with a first resistance strength and configured to be removably coupled to the accessory interface.

In addition, the present invention relates to a method of performing an exercise routine. In some embodiments, such a method comprises performing a first set of step aerobics using a stack of a lower exercise platform and an upper exercise platform, wherein the upper exercise platform comprises removable handle features, removing the upper exercise platform by grasping its handle features, and performing a second set of step aerobics using the lower exercise platform while holding the upper exercise platform and using it as a weight.

BRIEF DESCRIPTION OF THE SEVERAL DRAWING FIGURES

DETAILED DESCRIPTION OF THE EMBODIMENTS OF THE INVENTION

Two broad embodiments of the present invention are discussed below with reference to the included drawings. The discussion of the specific components of these embodiments should not be taken to disclaim equivalents of the structures described herein.

Structure

The central component of the embodiments of the present invention is a platform configured with resistance devices (preferably detachable) and detachable weight modules. In both the first embodiment, discussed with reference to FIGS. 1A to 5, and the second embodiment, discussed with reference to FIGS. 6 to 10, the platform is sized for easy and comfortable manipulation and use. Within the exemplary embodiment illustrated in the figures, the platform has a generally rectangular or square shape. However, it should be apparent that the platform is able to have any appropriate overall shape.

Figure 1A:
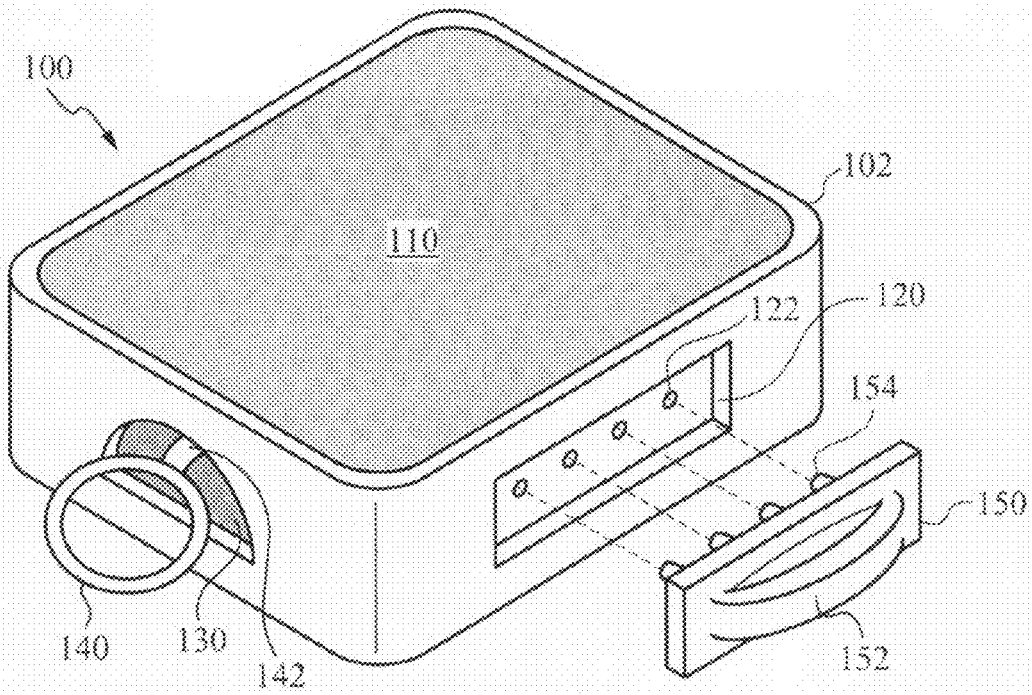
FIG. 1A is a semi-exploded perspective view of an alternative embodiment of the invention with a resistance device in place for use, and with a detached weight module.
Figure 1B:
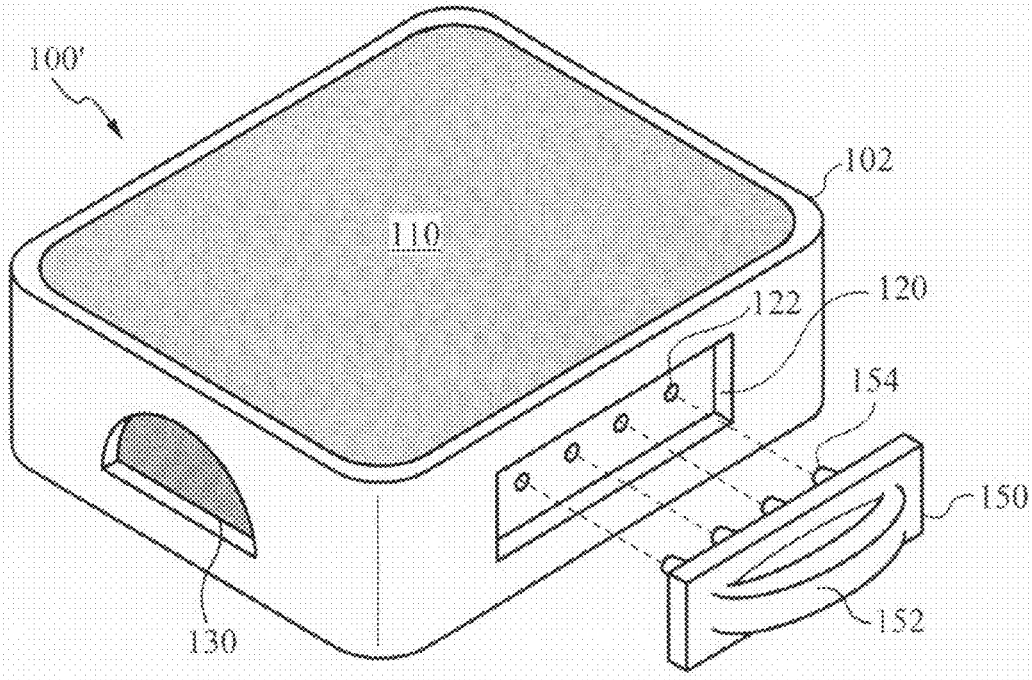
FIG. 1B is a semi-exploded perspective view of an alternative embodiment of the invention without a resistance device in place, and with a detached weight module.
Figure 6A:
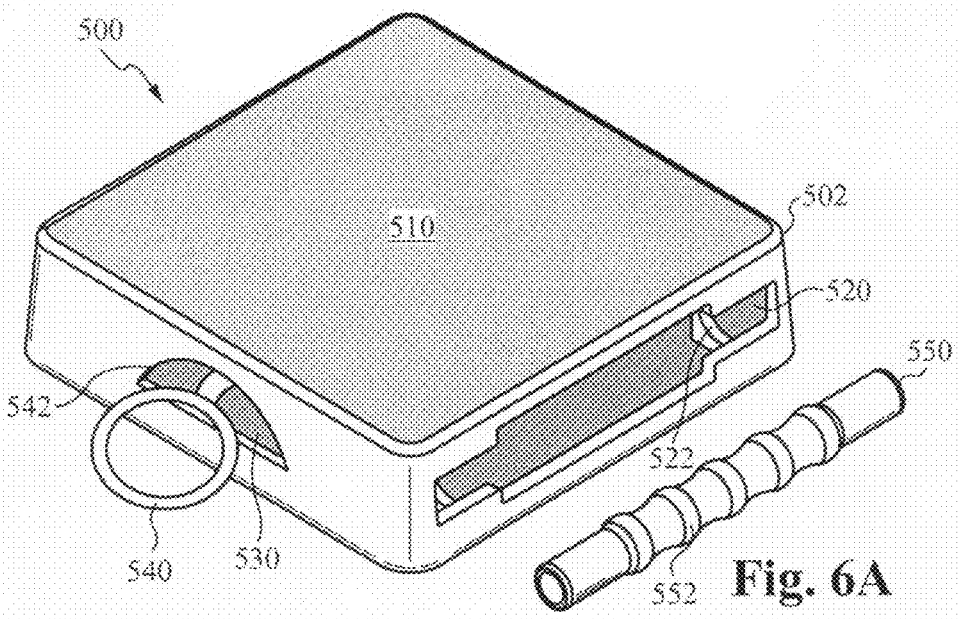
FIG. 6A is a semi-exploded perspective view of the preferred embodiment of the invention with a resistance device in place for use, and with a detached weight module.
Figure 6B:
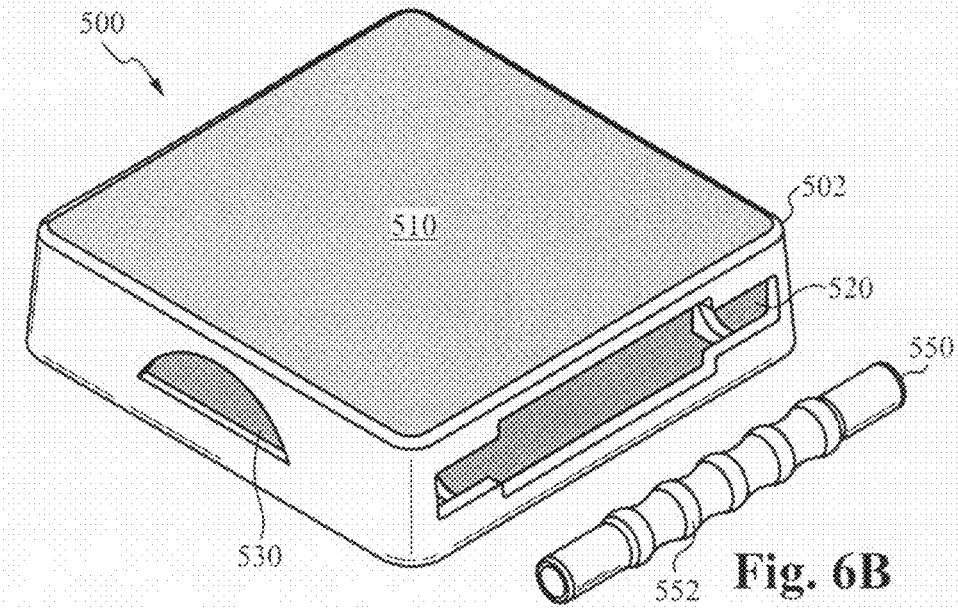
FIG. 6B is a semi-exploded perspective view of the preferred embodiment of the invention without a resistance device in place, and with a detached weight module.
Figure 7A:
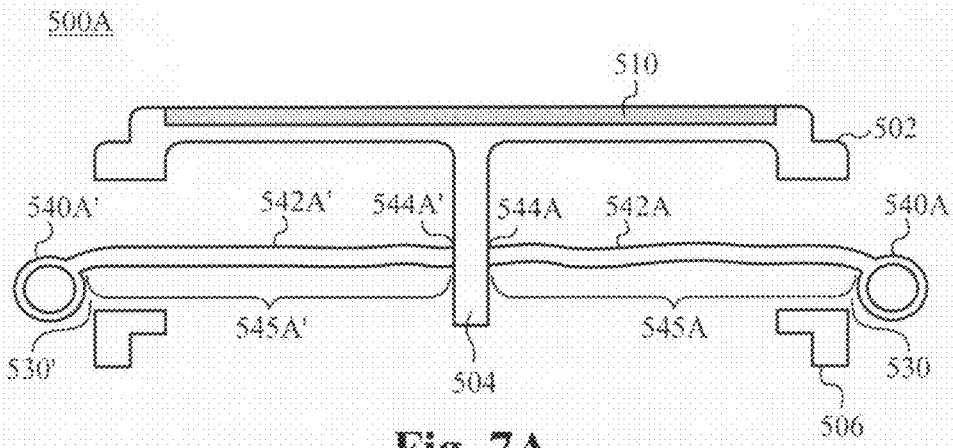
FIG. 7A is a cross-section view of an alternative embodiment of the invention with a resistance device in place for use.
Figure 7B:
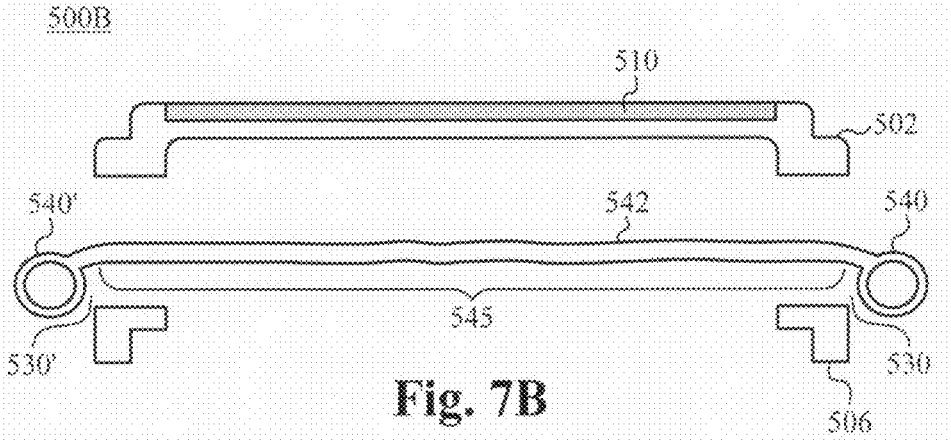
FIG. 7B is a cross-section view of the preferred embodiment of the invention with a resistance device in place for use.
Figure 7C:
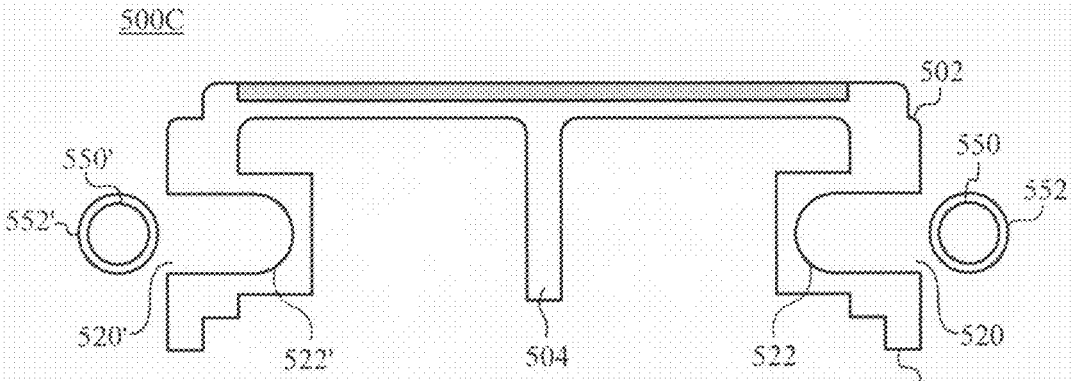
FIG. 7C is a cross-section exploded view of an alternative embodiment of the invention including two detached weight modules.

The general features of a platform, e.g. 100' of FIG. 1B or 500' of FIG. 6B, in accordance with the present invention are the following: a top surface, e.g. 110 or 510, an interlocking lip, e.g. 102 or 502, an accessory portal, e.g. 130 or 530, an interlocking lower edge, e.g. 106 of FIGS. 2A to 2C or 506 of FIGS. 7A to 7C, and walls. The walls of the platform are preferably substantially perpendicular to the top surface, or are otherwise able to support the top surface at some distance above a floor or other substantially planar supporting surface and substantially parallel to that supporting surface. Further, the top surface of the platform is preferably formed from a material having characteristics similar to a durable gel surface or AeroMat™, including at least the following: warm and comfortable to the touch, cushioning, lightweight, closed cell, durable, and non-slip. In some embodiments, the durable gel surface includes propylene glycol and water.

Figure 4A:
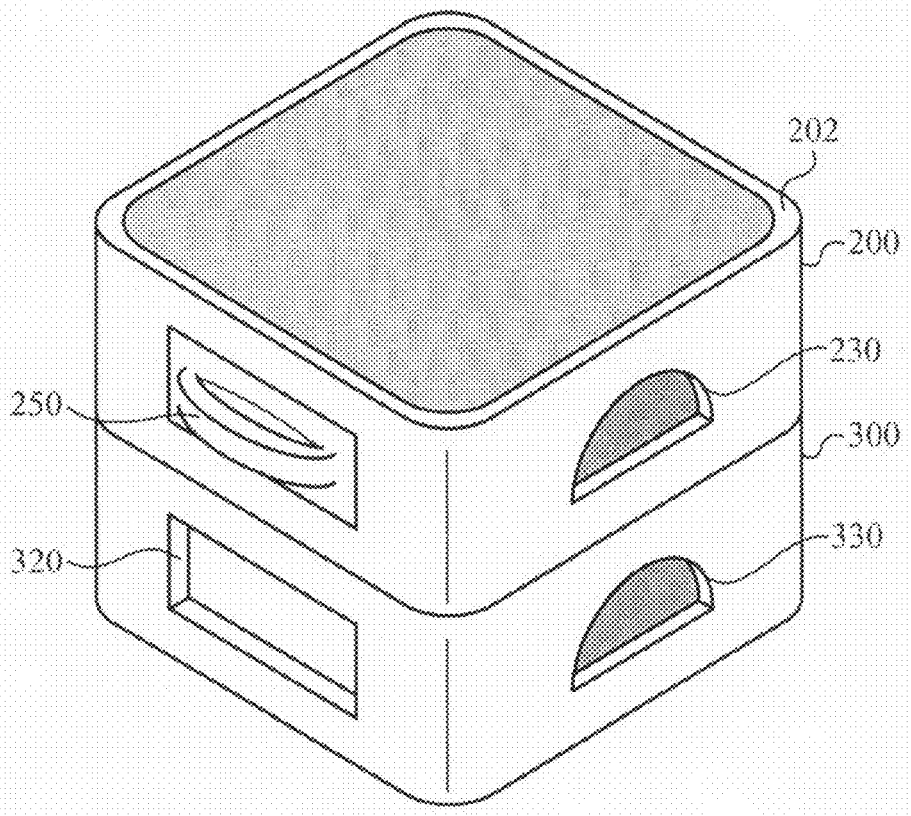
FIG. 4A is a perspective view of two platform devices of an alternative embodiment of the invention in a stacked configuration, without any resistance devices in place, and with a weight module attached for use.
Figure 9A:
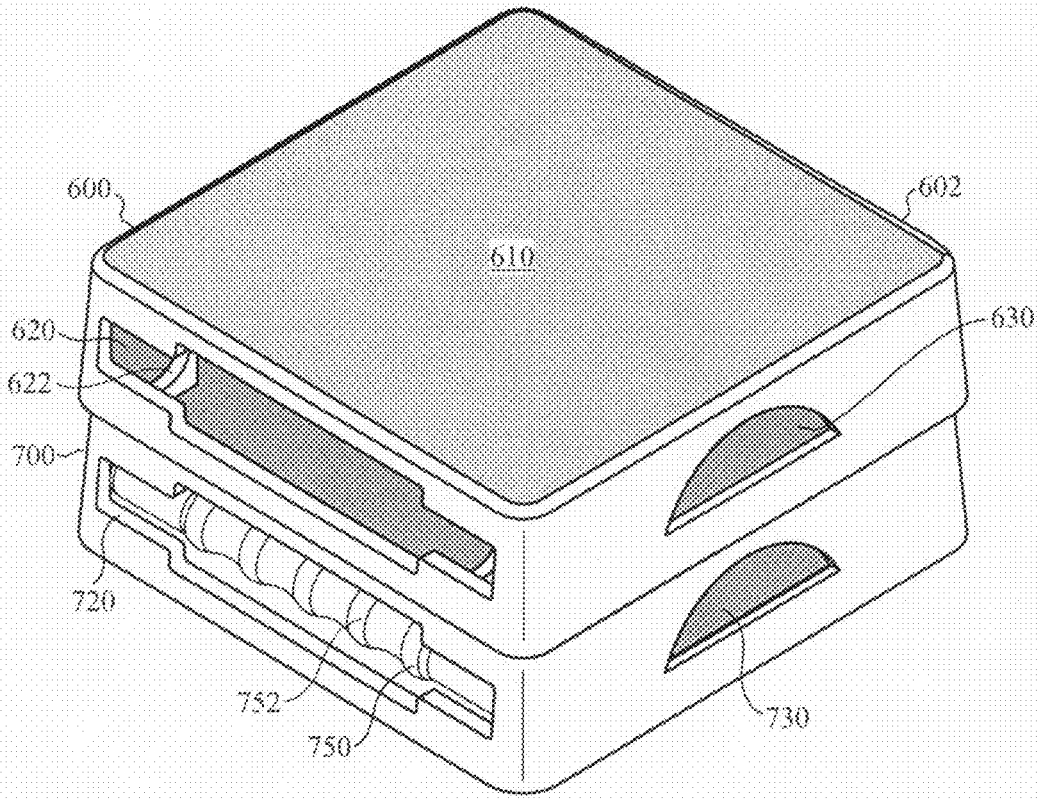
FIG. 9A is a perspective view of two platform devices of the preferred embodiment of the invention in a stacked configuration, without any resistance devices in place, and with a weight module attached for use.
Figure 9B:
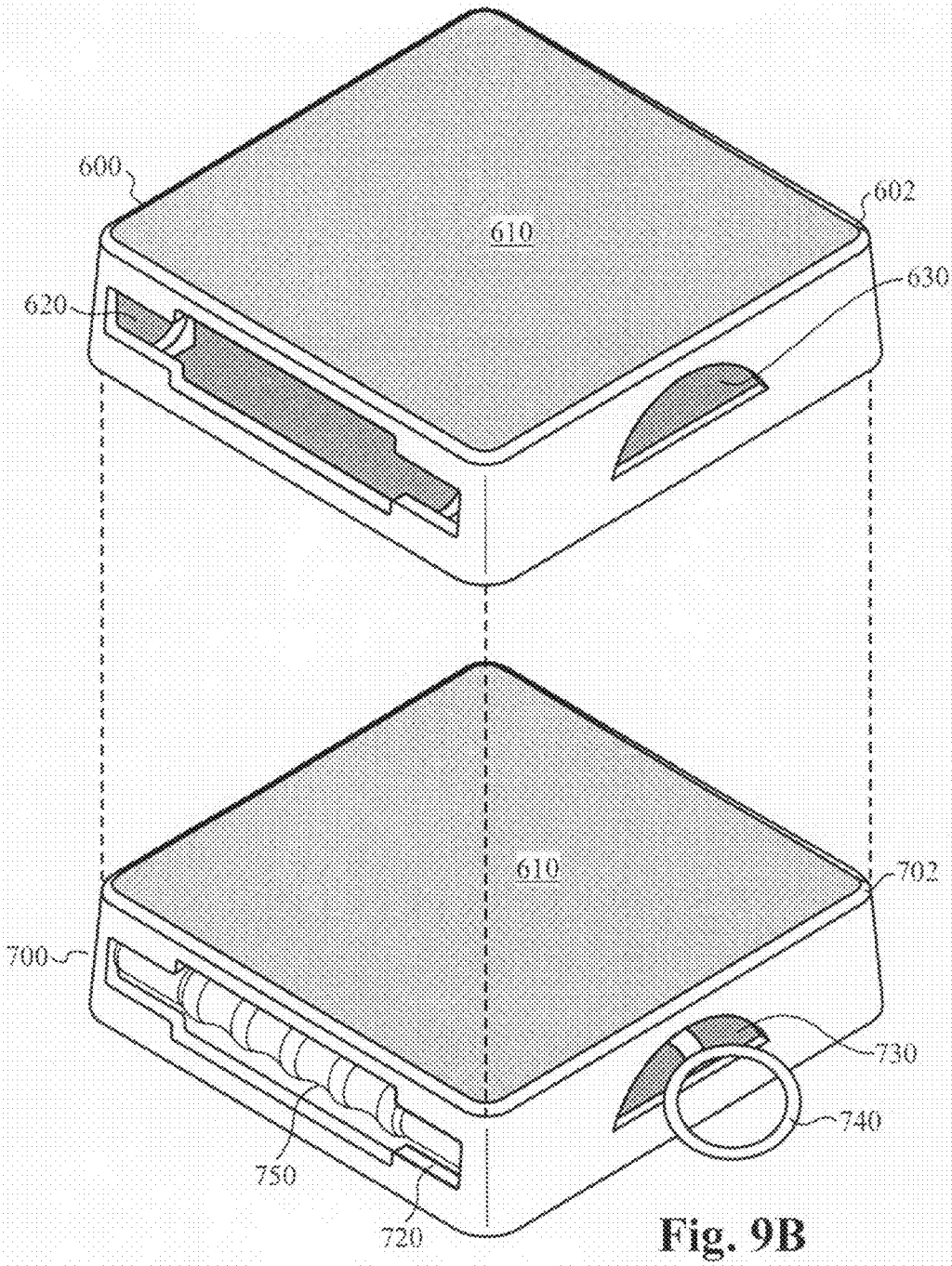
FIG. 9B is a perspective view of two platform devices of the preferred embodiment in an exploded stacked configuration, with a resistance device in place for use in the bottom platform, and with a weight module attached for use.
Figure 10:
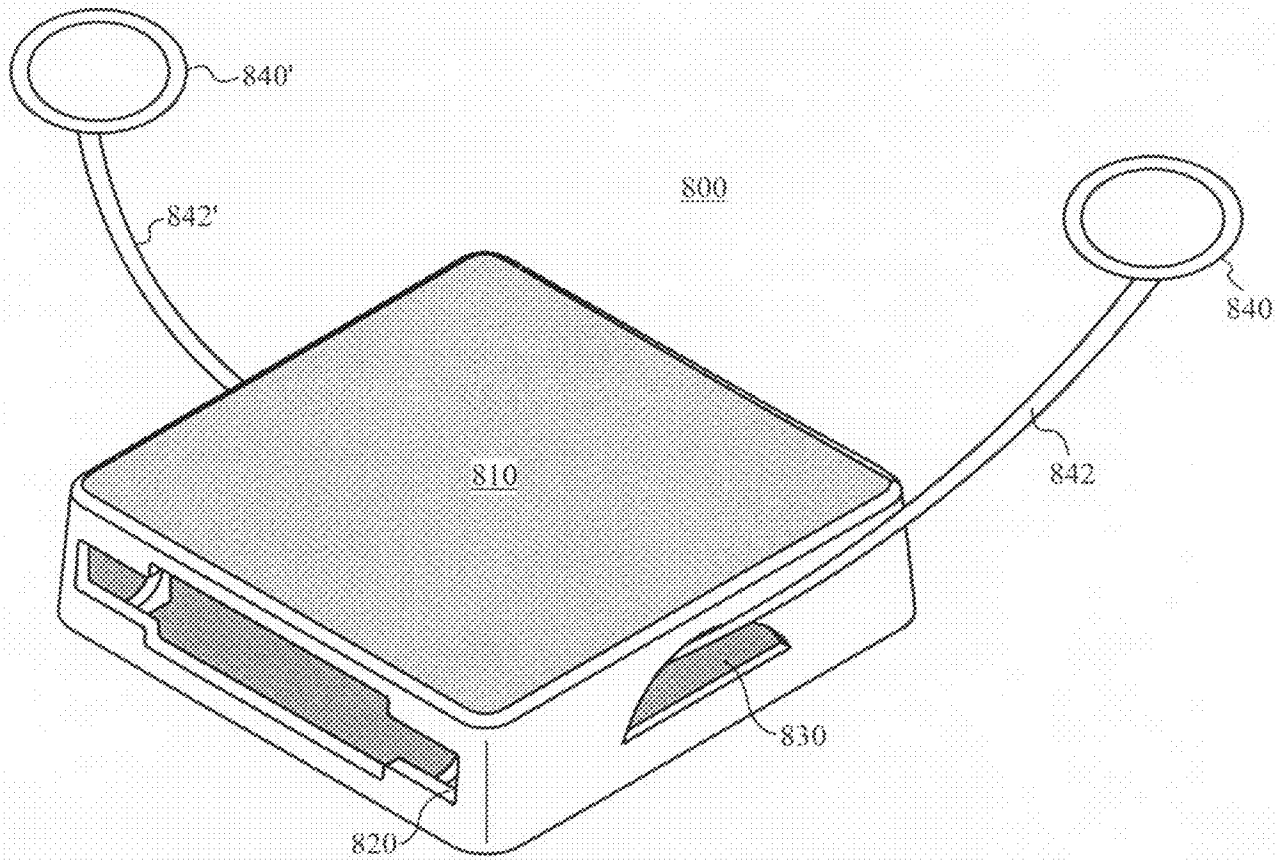
FIG. 10 is a perspective view of the preferred embodiment of the invention illustrating some possible movements of a resistance device during use.

The interlocking lip, e.g. 102 or 502, and interlocking lower edge, e.g. 106 or 506, permit stacking of one device with others of the same construction. FIGS. 4A and 9A each show two platform devices in a stacked configuration.

Figure 2A:
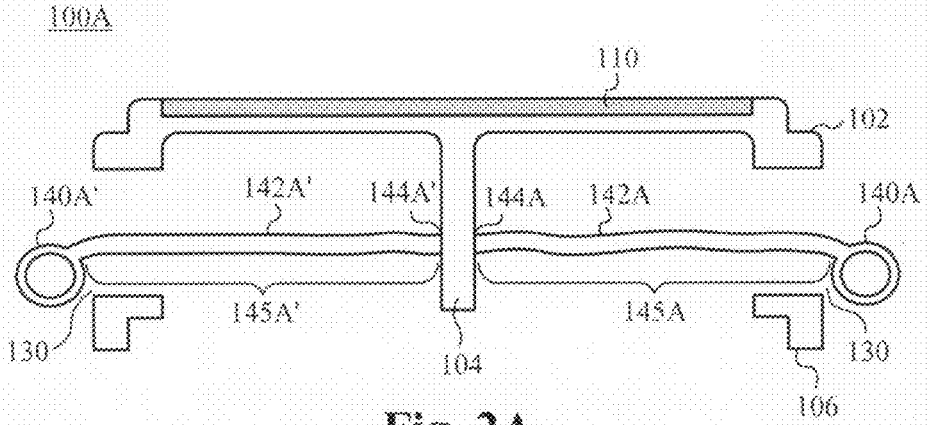
FIG. 2A is a cross-section view of an alternative embodiment of the invention with a resistance device in place for use.

In the various embodiments of the present invention, resistance devices are configured for operation with a platform. A variety of configurations are consistent with the present invention, such as coupling a resistance device with the platform or simply positioning a resistance device for use with the platform. In some embodiments, as illustrated in FIGS. 2A and 7A, resistance devices, e.g. 145A and 145A', are coupled to the platform at anchor points. In FIG. 2A the resistance device 145A is anchored to a cross-member 104 at the anchor point 144A, while the second resistance device 145A' is anchored to the cross-member 104 at the anchor point 144A'. In this type of embodiment, an exemplary resistance device 145A comprises a resilient portion 142A, a handle 140A, and the anchor point 144A. The resilient portion 142A is sized so that the handle 140A protrudes from the accessory portal 130. The handle 140A is sized to allow an adult to grasp it comfortably.

Figure 2B:
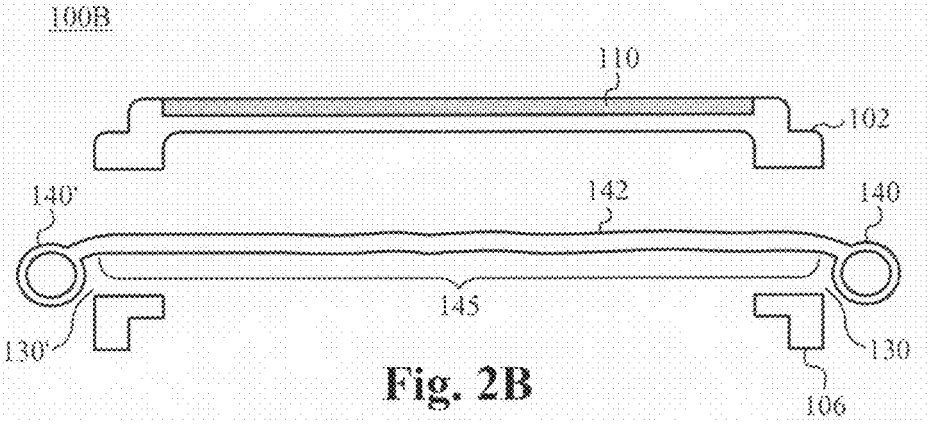
FIG. 2B is a cross-section view of an alternative embodiment of the invention with a resistance device in place for use.
Figure 2C:
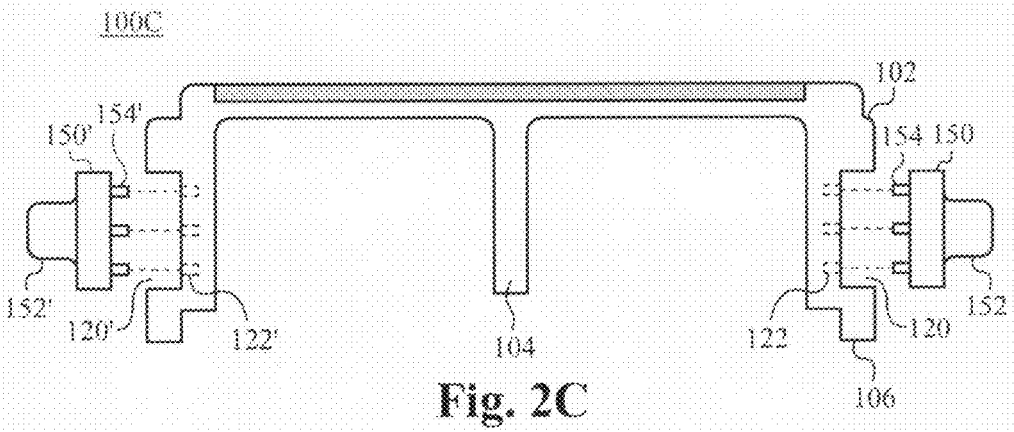
FIG. 2C is a cross-section exploded view of an alternative embodiment of the invention including two detached weight modules.

In other embodiments, such as those shown in FIGS. 2B and 7B, a resistance device, e.g. 142 of FIG. 2B or 542 of FIG. 7B, is positioned within a platform, 100B or 500B. The resistance device 145, for example, comprises a resilient portion 142 and two handles 140 and 140'. The resilient portion 142 is sized so that the handles 140 and 140' protrude from the accessory portals 130 and 130'. The handles 140 and 140' respectively are sized to allow an adult to grasp them comfortably.

Preferably, a variety of resistance devices of different resistive force and sizes for insertion into and use with a single platform body, are provided along with such a body in accordance with the present invention. Alternatively, as shown with reference to FIGS. 2A and 7A, an integrated resistance device is included with the platform.

Though the illustrated embodiments include only resistance devices as possible accessories, the present invention also contemplates inserting an exercise pole or any other appropriate device through the accessory portal.

The two broad embodiments differ most markedly in how the weights and weight couplings are constructed. In a first embodiment, illustrated and discussed with reference to FIGS. 1A to 5, the weight modules are provided as substantially parallelepiped objects including integrated handle features and platform interface features. In a second embodiment, illustrated and discussed with reference to FIGS. 6A to 10, the weight modules are provided as substantially cylindrical objects including integrated gripping features. Of course, the interface of the two types of weight modules with their respective platforms is appropriately different as well.

In FIG. 1A, the weight module 150 is shown in an exploded relationship to the platform 100. The weight module 150 includes a parallelepiped body and integrated handle 152, as well as the coupling features 154. The parallelepiped body is sized for insertion into the indented feature 120 of the platform 100. The coupling features 154 are sized to couple detachably with the coupling points 122 positioned within the indented feature 120. As illustrated, the coupling features 154 are disposed in a line centered on a face of the parallelepiped body opposite of the integrated handle 152, and parallel to the main axis of the handle 152. In an alternative embodiment illustrated in FIG. 2C, coupling features 154' (and their corresponding coupling points 122') are disposed perpendicularly to the main axis of the handle 152. In some embodiments, the handle features, e.g. 152, of the weight modules included in the present invention are sized to allow a user to grasp the weight module comfortably.

Figure 3A:
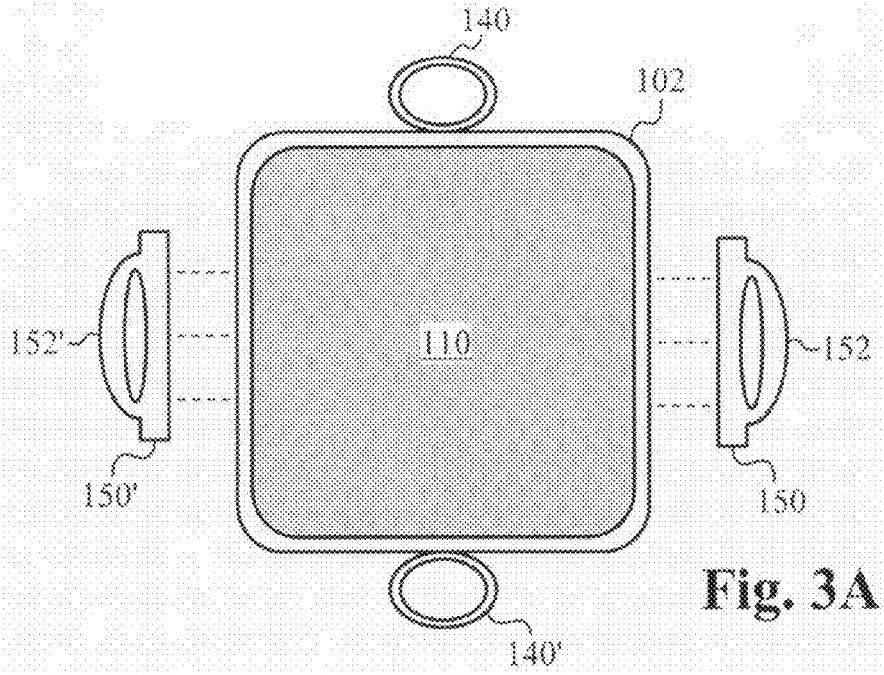
FIG. 3A is an exploded plan view of an alternative embodiment of the invention with a resistance device in place for use and two detached weight modules.
Figure 3B:
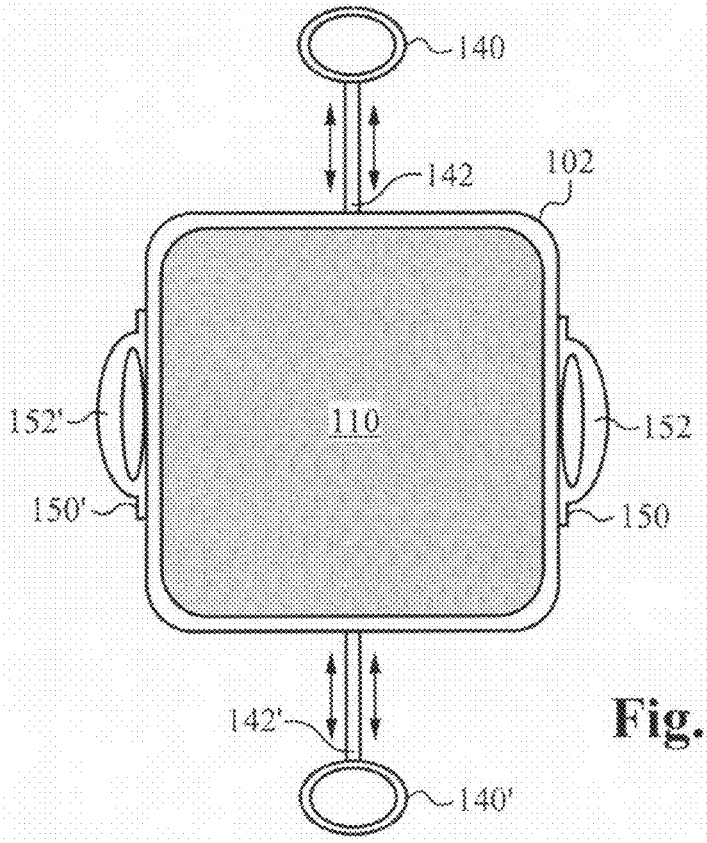
FIG. 3B is a plan view of an alternative embodiment of the invention illustrating some possible movements of a resistance device during use, and with two weight modules in place for use.

The interface between the weight module, e.g. 150, and the platform, e.g. 100, relies on the coupling of the coupling features, e.g. 154, with the coupling points, e.g. 122, to retain the weight module within the indented feature, e.g. 120, of the platform. FIG. 3B illustrates a platform with two weight modules, 150 and 150', inserted into it for use. The interface retains the weight modules within the indented features with sufficient force to permit a user to move the assembled platform around by the handles 152, 152' to perform weight-based exercises (using the weight of the full platform including both weight modules and possibly the resilient feature). In addition, the interface preferably permits a user to easily remove a weight module from the platform by bracing one hand against the platform body and pulling the handle without using undue force.

In accordance with this first broad embodiment of the present invention, a variety of different weight modules containing differing amounts of weight, but all having the general form factor of the weight module 150 are provided with a platform body. Preferably, the weight modules of varying weights each have substantially the same size and shape. This can be accomplished by a variety of means, all of which alter the overall density of the weight module. Examples include forming a piece of lead or other very dense material within the weight module. Modules with differing weights could have accordingly different amounts of lead, but the same overall shape. However, in this embodiment it is also possible for the form factor to vary slightly. For example, the thickness of the weight module (distance between face with integrated handle and that with the coupling features) can vary without substantial loss of functionality.

In FIG. 6A, the weight module 550 is shown in an exploded relationship to the platform 500. The weight module 550 includes a substantially cylindrical body having integrated gripping features 552. The weight module 550 is sized for insertion into the cutout feature 520 of the platform 500. The ends of the weight module 550 are sized to couple detachably with the coupling points 522 positioned within the cutout feature 520. Preferably, the handle features 552 and the size of the cylindrical body of the weight module 550 included in the present invention are sized to allow a user to grasp the weight module comfortably.

The interface between the weight module, e.g. 550, and the platform, e.g. 500, relies on the coupling of the cylindrical body with the coupling points, e.g. 522, to retain the weight module within the cutout feature, e.g. 520, of the platform. FIG. 7C illustrates an exploded cross-sectional view including two weight modules, 550 and 550' and the coupling points 522 and 522'. Preferably, when the weight modules are inserted, two coupling points hold each weight module. In FIG. 7C, only two of four total coupling points are shown. FIG. 9A illustrates a platform 700 with a weight module 750 inserted into it for use. The cutout features 720 are sufficiently large in their center regions to permit a user's hand to grasp the region of the weight module 750 that includes gripping features 752 while the weight module is coupled to the coupling points (not shown, but analogous to 622) within the platform.

Preferably the interface between the coupling points and the weight module 750 retains the weight module within the cut-out region 720 with sufficient force to permit a user to move the assembled platform around by gripping the region of the weight module 750 that includes gripping features 752 to perform weight-based exercises (using the weight of the full platform including both weight modules and possibly the resilient feature). In addition, the interface preferably permits a user to easily remove the weight module from the platform by bracing one hand against the platform body and pulling the handle without using undue force.

The substantially cylindrical weight modules require tighter tolerances in their interface with the coupling points. Weight modules of varying heaviness designed for use with a single platform must be substantially the same size and shape in order to ensure that a user's hand can fit into the cutout region and grasp the gripping features of the weight module of an assembled platform. As mentioned above, one possible method for constructing such weights is to encase varying amounts of a very dense material, e.g. lead, within multiple modules of the same size.

Figure 11A:
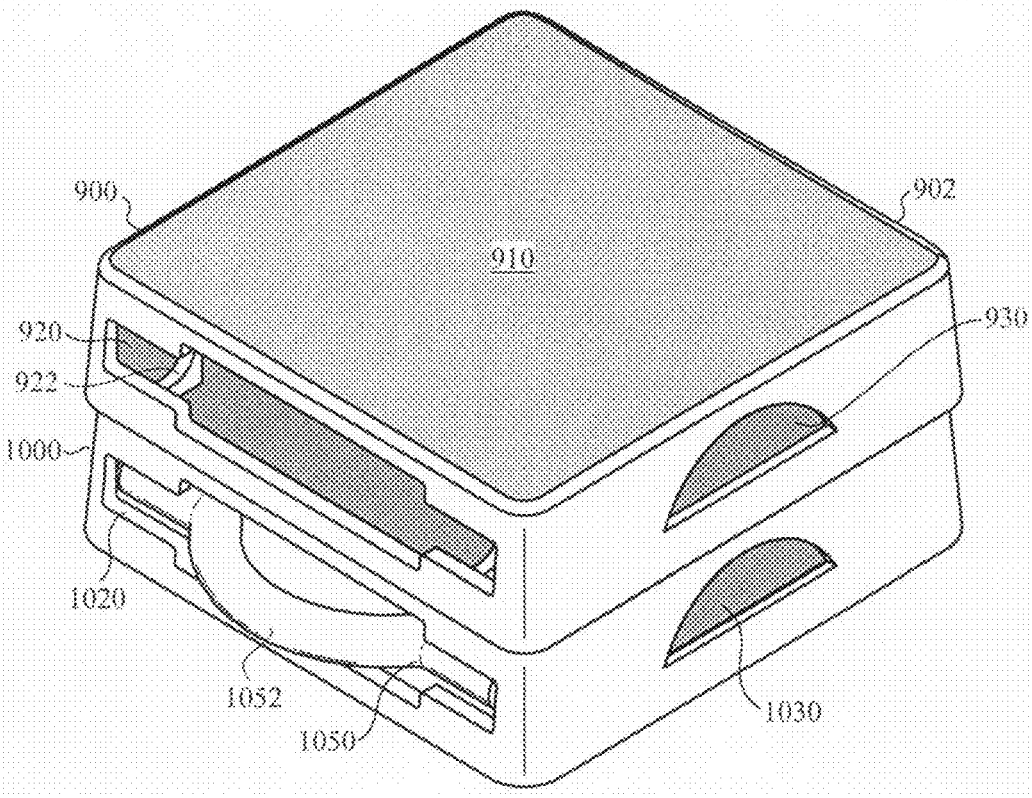
FIG. 11A is a perspective view of two platform devices of an alternative embodiment of the invention in a stacked configuration, without any resistance devices in place, and with a weight module attached for use.
Figure 11B:
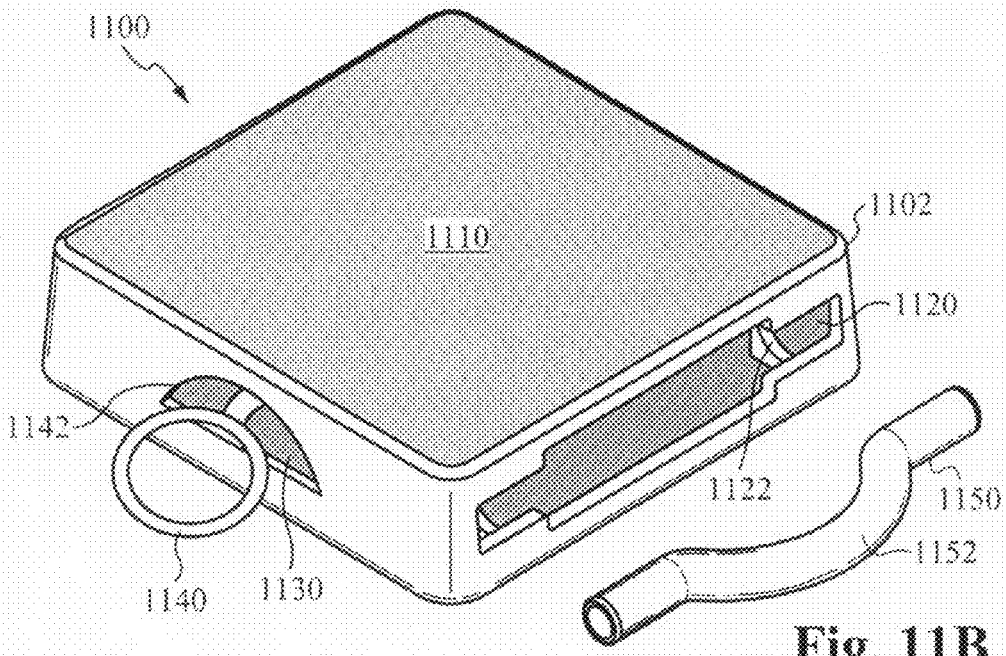
FIG. 11B is a semi-exploded perspective view of an alternative embodiment of the invention with a resistance device in place for use, and with a detached weight module.

In FIG. 11B, the weight module 1150 is shown in an exploded relationship to the platform 1100. The weight module 1150 includes substantially cylindrical ends connected to a curved handle 1152. The weight module 1150 is sized so that its ends are insertable into the cutout feature 1120 of the platform 1100. The ends of the weight module 1150 are sized to couple detachably with the coupling points 1122 positioned within the cutout feature 1120. Preferably, the handle 1152 and the size of the cylindrical body of the weight module 1150 included in the present invention are sized to allow a user to grasp the weight module comfortably.

The interface between the weight module, e.g. 1150, and the platform, e.g. 1100, relies on the coupling of the cylindrical ends with the coupling points, e.g. 1122, to retain the weight module within the cutout feature, e.g. 1120, of the platform. As shown in FIG. 11A, when a weight module 1050 of the type illustrated is inserted, two coupling points (not visible here) each hold one end of the weight module 1050. While the weight module 1050 is inserted, the handle 1052 protrudes from the exterior walls of the platform 1000, providing sufficient space for a user to comfortably grab the handle 1052 while the weight module is coupled to the coupling points (not shown, but analogous to 922) within the platform.

Preferably the interface between the coupling points and the weight module 1050 retains the ends of the weight module within the cut-out region 1020 with sufficient force to permit a user to move the assembled platform around by gripping the handle 1052 to perform weight-based exercises (using the weight of the full platform including both weight modules and possibly the resilient feature). In addition, the interface preferably permits a user to easily remove the weight module from the platform by bracing one hand against the platform body and pulling the handle without using undue force.

The substantially cylindrical ends of these weight modules require tight tolerances in their interface with the coupling points. Weight modules of varying heaviness designed for use with a single platform must have ends of substantially the same size and shape in order to ensure that they can each fit into the platform. As mentioned above, one possible method for constructing such weights is to encase varying amounts of a very dense material, e.g. lead, within multiple modules of the same size.

Operation

In operation, the present invention provides multiple exercise functions in a single package. For even more options, the present invention allows for multiple platforms to combine, providing additional exercise functions.

The most basic function of the present invention is that of a simple platform for step aerobics or core exercises. However, unlike conventional steps, the platform, e.g. 100, includes an integrated durable gel surface or AeroMat™-type feature, e.g. 110, that provides a softer top surface to reduce potential impacts during aerobic exercise. In addition the top surface provides a soft and comfortable surface for a user kneeling, sitting, or laying on the platform. Furthermore, because the top surface is less stable than a hard bench surface, it requires a user's leg to stabilize itself, which promotes balance and core stability. In some embodiments, the durable gel surface includes propylene glycol and water.

As illustrated best in FIGS. 2A-2C and 7A-7C, platforms in accordance with the present invention include lower edges, e.g. 106, and upper lips, e.g. 102, that are configured to mate during stacking of two platforms. Thus, the stacks of platforms illustrated in FIGS. 4A, 4B, 8A, and 8B also provide a solid aerobics and core exercise platform. With this feature, stacked platforms will not slip apart under reasonable forces exerted within the plane of the upper surface of the stack, such as are common during an exercise routine in which a person steps on and off of the stack.

In the preferred embodiment of the invention, illustrated in FIGS. 6A, 6B, 7B, and 8A to 10, a resistance or other accessory device is not coupled with the platform, but two accessory holes, e.g. 530, 530' of FIG. 7B are included. The accessory holes permit an accessory device to pass through the platform, adding additional exercise functions to it. For example, a resistance device 545 passes through the accessory holes 530 and 530' and allows the user to perform resilient exercises against her own body weight and arm strength whilst standing on the platform or bracing against it. When used correctly, the resilient portions of the resistance device will stretch around and against the accessory portals when the handles of the resistance device are pulled upwards (so long as there is sufficient weight on the platform). For example, in FIG. 10, a resistance device is shown in a stretched configuration. The resilient portions 842 and 842' are stretched against the accessory portals (only 830 is shown). This elongated configuration preferably occurs when an upward or outward force is exerted on the handles 840 and 840'. Since in this configuration, the resistance device exerts a strong upward restoring force on the platform body, the configuration is preferably entered whilst a user stands, sits, kneels, or lies on the platform.

Figure 8A:
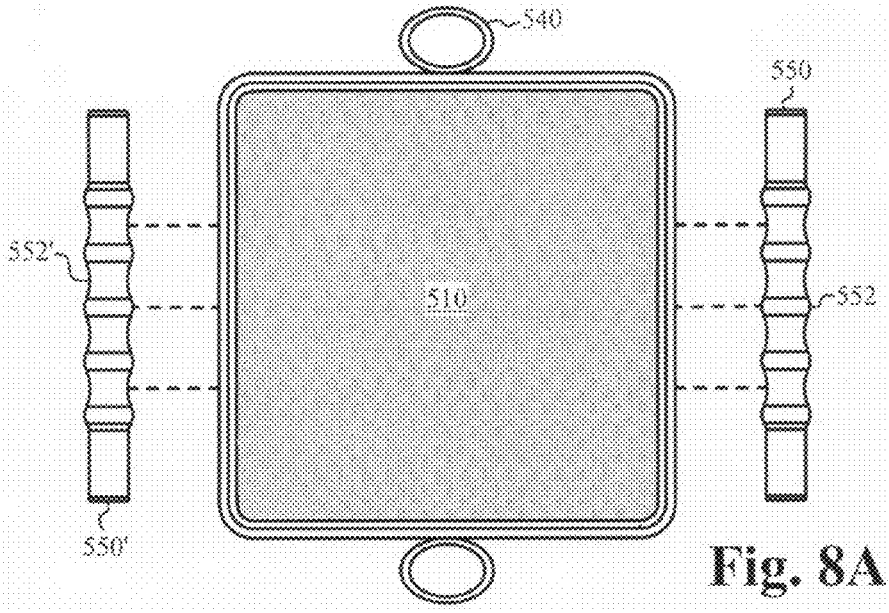
FIG. 8A is an exploded plan view of the preferred embodiment of the invention with a resistance device in place for use and two detached weight modules.
Figure 8B:
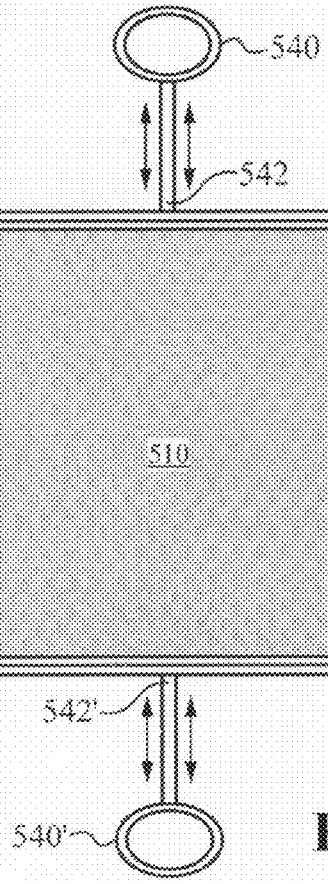
FIG. 8B is a plan view of the preferred embodiment of the invention illustrating some possible movements of a resistance device during use, and with two weight modules in place for use.

In addition, other stretched configurations are possible. For example, as illustrated in FIG. 8B, a configuration where a resistance device is stretched substantially only in the plane defined by the two accessory portals is illustrated. Here, the resilient portions 542 and 542' exert substantially no upward restoring force on the platform. Of course, a user must place sufficient force on the resistance device, preferably on its handles 540 and 540', to stretch the device.

Notably, the accessory portals, e.g. 130, 530, are semi-elliptical in shape. This shape allows a relatively large handle, e.g. 140, 540, to be inserted through an accessory portal, while providing a constraint for a small-diameter exercise pole accessory. Specifically, a pole inserted through two accessory portals disposed on opposite walls of a platform will be limited in diameter to the diameter of the largest circle circumscribed by the semi-ellipse of the portal. On the other hand, handles of a larger diameter (equal to the length of the bottom of the semi ellipse) can be slid through along the bottom of the semi-elliptical accessory portal.

In addition, platforms according to the present invention permit weight training with a variety of weight levels. Specifically, as discussed above, weight modules in accordance with the present invention, e.g. 150, 550 or 1050, couple with platform bodies of the present invention, e.g. 100, 500 or 900, to form assembled platforms suitable for weight training uses, e.g. 200, 700, 1000. With the weight modules in place and serving as handles, a user is able to perform a variety of exercises by grasping one or more of the handles and moving the platform relative to her body.

In some embodiments, a platform in accordance with the present invention is provided along with a plurality of weight module sets, each of differing weights, and a plurality of resistance devices, each of differing resistance, to permit a user to perform a variety of exercises having varying difficulties. Of course, in other embodiments, notably those illustrated in FIGS. 2A and 7A, integrated resistance devices are provided with a platform. In this case, providing multiple resistance devices is not preferable.

Figure 4B:
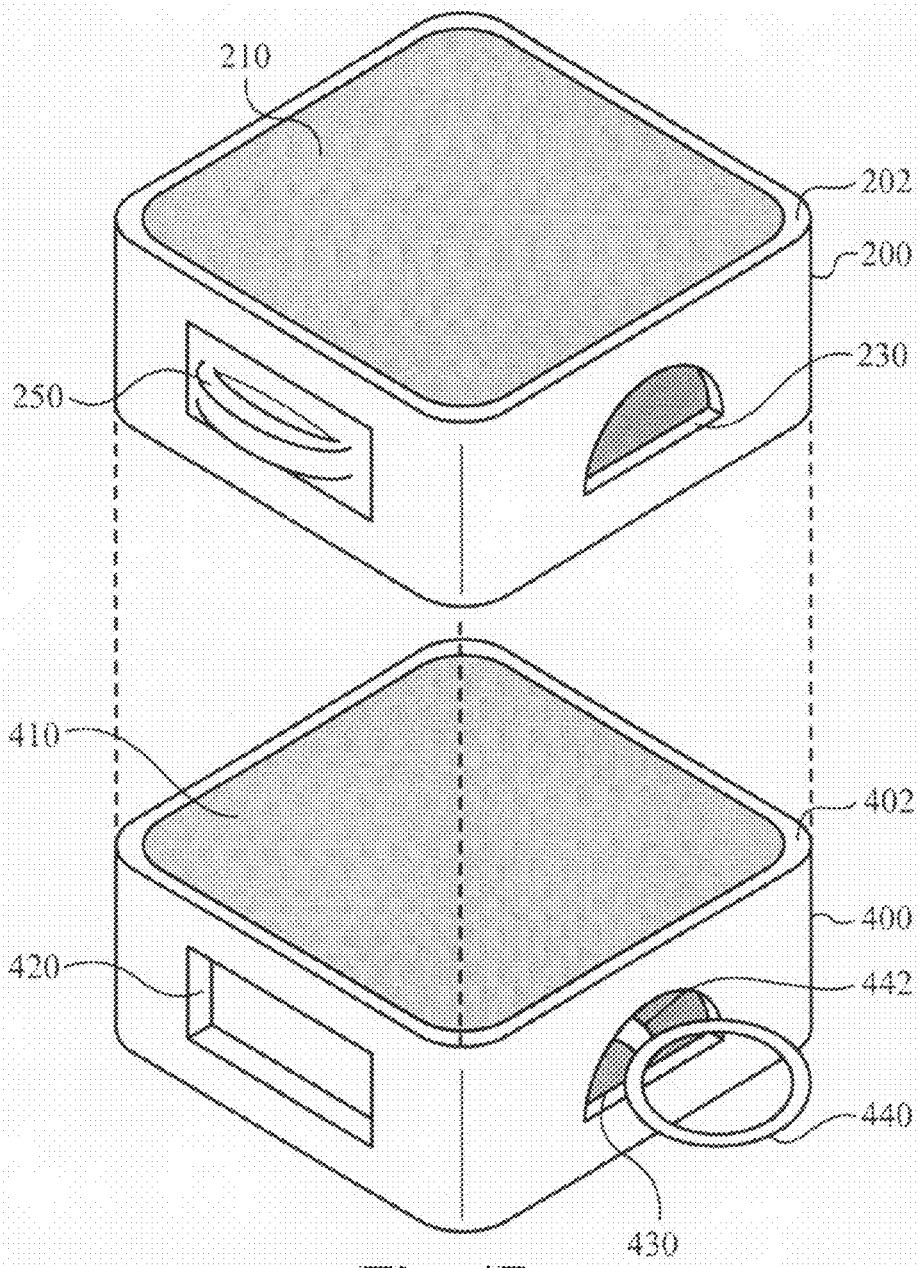
FIG. 4B is a perspective view of two platform devices of an alternative embodiment of the invention in an exploded stacked configuration, without a resistance device in place for use in the bottom platform, and with a weight module attached for use in the top platform.
Figure 5:
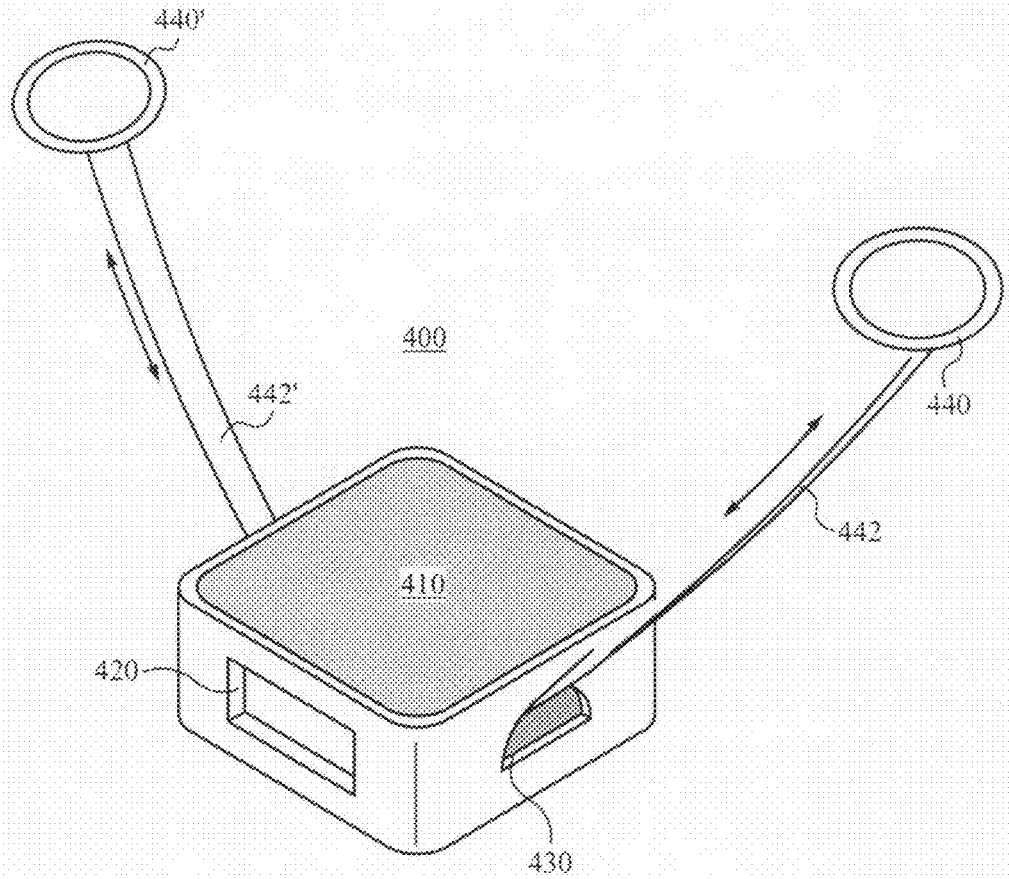
FIG. 5 is a perspective view of an alternative embodiment of the invention illustrating some possible movements of a resistance device during use.

The interlocking edges of the platforms, and the fact that accessories and weight modules are interchangeable between platforms of the same construction, means that platforms according to the present invention have modular construction. By combining two or more platforms, more exercises are possible, and not simply step aerobics using a doubly high platform. A good example is the configuration illustrated in FIG. 4A that provides a doubly high platform of which the upper platform can be removed for use in weight training exercises. With the addition of a resistance device, as shown in FIG. 4B, even more exercises are possible using the same two platforms. For example, a user is able to remove the top platform and use it as a weight whilst performing step aerobics exercises using the bottom platform. In another mode, a user could perform step aerobics exercises on the doubly high platform whilst simultaneously using the resistance device within the bottom platform to provide resistance exercises.

Preferred Embodiment

The preferred embodiment of the present invention is as illustrated in FIGS. 6A, 6B, 7B, and 8A to 10. Several sets of weight modules of varying heaviness are provided, as are several resistance devices of varying strength, and at least one exercise pole. Further, the platform body is preferably 14"× 14"×4" and is constructed from plastic. The weight modules are preferably 1" in diameter and 12" long.

The present invention provides many fitness functions in a single, compact unit. Devices in accordance with the present invention can aid cardiovascular, muscular, and balance or core training. By combining a soft, elevated pad to aid in balance training, removable weights, and an ability to add other equipment (e.g. resistance devices) in a compact package, devices in accordance with the present invention provide a high level of functionality without taking up much space. Because of its compactness, a device in accordance with the present invention can be used by multiple persons in a single confined space, such as a yoga studio.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made to the embodiments chosen for illustration without departing from the spirit and scope of the invention.

We claim:

1. A step exercise device, comprising:

a. a rigid housing including a platform-supporting structure and a weight-module retaining structure on the exterior of the platform-supporting structure, wherein the weight-module retaining structure comprises an expanded dimension that creates a cavity between the weight-module and the weight-module retaining structure when the weight-module is coupled to the weight-module retaining structure;

b. a platform surface formed of an elastomeric material configured to deform under body weight, coupled to the platform-supporting structure of the rigid housing; and c. at least one cylindrical weight-module configured to be selectively coupled within the weight-module retaining structure such that the weight-module is entirely within the platform-supporting structure, allowing the weight-module to be accessed and separated from the weight-module retaining structure while a user is stepping on the platform surface and also directly above the rigid housing.

2. The step exercise device of claim 1, wherein the rigid housing includes a lower edge and an upper edge, and further wherein the upper edge and lower edge of the rigid housing are configured in shapes that are mate-able with one another.

3. The step exercise device of claim 1, wherein the elastomeric material is one of chloroprene and neoprene.

4. The step exercise device of claim 1, wherein the elastomeric material comprises propylene, glycol and water.

5. The step exercise device of claim 1, wherein the rigid housing is formed of a thermoplastic.

6. The step exercise device of claim 1, further comprising a weight module with coupling features removably coupled to the weight-module retaining structure at coupling points.

7. The step exercise device of claim 1, wherein the rigid housing further includes an accessory interface.

8. The step exercise device of claim 7, further comprising a resistance device removably coupled to the accessory interface.

9. An exercise system, comprising:

a. a first exercise step comprising:

i. a first housing including a first platform-supporting structure, a first upper lip, a first lower lip, and a first weight-retaining structure on the exterior of the first platform-supporting structure, wherein the weight-retaining structure comprises an expanded dimension that creates a cavity between the weight module and the weight-retaining structure when the weight module is coupled to the weight-retaining structure;

ii. a first platform surface formed of an elastomeric material configured to deform under body weight, coupled to the first platform-supporting structure of the first housing; and iii. at least one cylindrical weight module configured to be selectively coupled within the first weight-retaining structure such that the weight module is entirely within the first platform-supporting structure, allowing the weight module to be accessed and separated from the first weight retaining structure while a user is stepping on the first platform surface and also directly above the first housing; and b. a second exercise step comprising:

i. a second housing including a second platform-supporting structure, a second upper lip and a second lower lip; and ii. a second platform surface formed of an elastomeric material configured to deform under body weight, coupled to the second platform-supporting structure of the second housing;

wherein, the first upper lip is configured to mate with the second lower lip, and the second upper lip is configured to mate with the first lower lip, such that the first exercise step is able to be stably stacked upon the second exercise step and the second exercise step is able to be stably stacked upon the first exercise step.

10. A multi-functional exercise device, comprising:

a. a body including a platform-supporting structure, a weight-retaining structure on the exterior of the platform-supporting structure, and an accessory interface;

b. a platform surface formed of a material that deforms under body weight, providing substantially less stability when stood upon than would a hard surface, coupled to the platform-supporting structure of the body; and c. a cylindrical weight module removably coupled to the weight-retaining structure of the body, wherein the weight module is accessible and separatable from the weight-retaining structure while a user is stepping on the platform surface and also directly above the body;

wherein the weight-retaining structure comprises an expanded dimension that creates a cavity between the weight module and the weight-retaining structure when the weight module is coupled to the weight-retaining structure such that the weight module is entirely within the platform-supporting structure.

11. The multi-functional exercise device of claim 10, wherein the platform surface material is elastomeric foam.

12. The multi-functional exercise device of claim 10, wherein the platform surface material is one of neoprene and chloroprene.

13. The multi-functional exercise device of claim 10, wherein the platform surface material has the following properties: cushioning, closed-cell, and non-slip.

14. The multi-functional exercise device of claim 10, wherein the platform surface material comprises a durable gel surface comprising propylene, glycol and water.

15. The multi-functional exercise device of claim 10, wherein the body is formed from a thermoplastic.

16. The multi-functional exercise device of claim 10, wherein the platform-supporting structure is configured to be substantially parallel to any parallel supporting surface upon which the device is placed.

17. The multi-functional exercise device of claim 10, wherein the body includes a second weight-retaining structure and the device includes a second weight module.

18. The multi-functional exercise device of claim 10, wherein the weight-retaining structure couples to the weight module at each of a plurality of anchor points.

19. The multi-functional exercise device of claim 10, wherein the weight module comprises a substantially parallelepiped body and an integrated handle.

20. The multi-functional exercise device of claim 10, wherein the weight module comprises a substantially cylindrical body with integrated gripping features.

21. The multi-functional exercise device of claim 10, wherein the weight-retaining structure couples the weight module with sufficient force to permit a user to lift an assembled device by gripping a portion of the weight module.

22. The multi-functional exercise device of claim 21, wherein the portion gripped is an integrated handle.

23. The multi-functional exercise device of claim 21, wherein the portion gripped comprises integrated gripping features.

24. The multi-functional exercise device of claim 10, wherein the weight-retaining structure couples the weight module with sufficiently low force to permit a user to remove the weight module with her hands.

25. The multi-functional exercise device of claim 10, wherein the platform surface material provides a shock-absorbing function during a foot-strike.

26. The multi-functional exercise device of claim 10, wherein the platform surface material destabilizes a user standing upon it.

27. The multi-functional exercise device of claim 10, wherein the accessory interface comprises two apertures disposed on opposite faces of the body.

28. The multi-functional exercise device of claim 27, wherein the apertures are elliptical.

29. The multi-functional exercise device of claim 28, wherein the exercise device further comprises an accessory cylindrical rod configured to fit through both of the apertures.

30. The multi-functional exercise device of claim 28, wherein the exercise device further comprises an accessory resistance device that includes a first handle and a second handle coupled together by a resilient strand, and wherein the first handle and the second handle are configured to fit through apertures when aligned along major axes of the elliptical apertures, but not when aligned along minor axes of the elliptical apertures.

31. The multi-functional exercise device of claim 10, wherein the accessory interface comprises two apertures disposed on opposite faces of the body and a central support disposed within the body.

32. The multi-functional exercise device of claim 31, wherein the exercise device further comprises a first accessory resistance device that includes a resilient strand removably couplable to the central support and a handle sized to fit through one of the apertures.

33. The multi-functional exercise device of claim 32, wherein the exercise device further comprises a second accessory resistance device that includes a resilient strand removably couplable to the central support and a handle sized to fit through one of the apertures.

34. The multi-functional exercise device of claim 10, further comprising a resistance device removably coupled to the accessory interface of the body.

35. An exercise system adaptable to aid a user in performing a plurality of exercise movements, comprising:

a. an exercise platform including a surface formed from a resilient foam material, an accessory interface, and two or more weight-module interface features on the exterior of the exercise platform;

b. a first weight module set comprising two cylindrical weight modules each having a first weight and configured to be removably coupled to the exercise platform via the weight-module interface features, wherein the first weight module set is accessible and separatable from the weight-module interface features while a user is stepping on the platform surface and also directly above the exercise platform;

c. a second weight module set comprising two cylindrical weight modules each having a second weight and configured to be removably coupled to the exercise platform via the weight-module interface features, wherein the first weight and the second weight are different, further wherein the first weight module set and the second weight module set are interchangeable within the weight-module interface features; and d. a resistance device set comprising a first resistance device with a first resistance strength and configured to be removably coupled to the accessory interface;

wherein the weight-module interfaces comprise an expanded dimension that creates a cavity between the first and second weight module sets and the weight-module interfaces when either the first or second weight module sets are coupled to the weight-module interfaces such that the weight modules are entirely within the exercise platform.

36. The exercise system of claim 35, further comprising a second resistance device with a second resistance strength also configured to be removably coupled to the accessory interface, wherein the first resistance strength and the second resistance strength are different.

37. The exercise system of claim 35, further comprising a pole configured to couple with the accessory interface.

38. The exercise system of claim 35, wherein each of the first set of weight modules and the second set of weight modules are substantially the same size and shape.

39. A method of performing an exercise routine, comprising:

a. performing a first set of step aerobics using a stack of a lower exercise platform and an upper exercise platform, wherein the upper exercise platform comprises removable handle features and weight modules contained on the exterior of the upper exercise platform, allowing the cylindrical weight modules to be accessed and separated while a user is stepping on the upper exercise platform and also directly above the exercise platform;

b. removing the upper exercise platform by grasping its handle features; and c. performing a second set of step aerobics using the lower exercise platform while holding the upper exercise platform and using the upper exercise platform as a weight;

wherein the exterior of the upper exercise platform comprises an expanded dimension that creates a cavity between the weight modules and the exterior of the upper exercise platform when the weight modules are coupled to the exterior of the upper exercise platform such that the weight modules are entirely within the upper exercise platform.

40. A step exercise device comprising:

a. a rigid housing including a platform-supporting structure and a weight-module retaining structure on the exterior of the platform-supporting structure, wherein the weight-module retaining structure is an indented feature with coupling points that retains a weight module entirely within the exterior of the platform-supporting structure;

b. a platform surface formed of an elastomeric material configured to deform under body weight, coupled to the platform-supporting structure of the rigid housing; and at least one cylindrical weight module configured to be selectively coupled within the weight-module retaining structure, allowing the weight module to be accessed and separated from the weight-module retaining structure while a user is stepping on the platform surface and also directly above the rigid housing.

41. A step exercise device comprising:

a. a rigid housing including a platform-supporting structure and a weight-module retaining structure on the exterior of the platform-supporting structure, wherein the weight-module retaining structure couples to a weight-module at a proximal end and a distal end of the weight-module;

b. a platform surface formed of an elastomeric material configured to deform under body weight, coupled to the platform-supporting structure of the rigid housing; and c. at least one cylindrical weight-module configured to be selectively coupled within the weight-module retaining structure such that the weight-module is entirely within the platform-supporting structure, allowing the weight-module to be accessed and separated from the weight-module retaining structure while a user is stepping on the platform surface and also directly above the rigid housing.

42. A multi-functional exercise device, comprising:

a. a body including a platform-supporting structure, a weight-retaining structure on the exterior of the platform-supporting structure, and an accessory interface;

b. a platform surface formed of an elastomeric material configured to deform under body weight, coupled to the platform-supporting structure of the rigid housing;

c. a cylindrical weight module removably coupled to the weight-retaining structure of the body such that the weight module is entirely within the platform-supporting structure, wherein the weight module is accessible and separatable from the weight-retaining structure while a user is stepping on the platform surface and also directly above the body; and d. an accessory resistance device that includes a first handle and a second handle integrally coupled together by a resilient strand, wherein the resilient strand passes entirely through the accessory interface during use.

43. A multi-functional exercise device, comprising:

a. a body including a platform-supporting structure, a weight-retaining structure on the exterior of the platform-supporting structure, and an accessory interface;

b. a platform surface formed of an elastomeric material configured to deform under body weight, coupled to the platform-supporting structure of the rigid housing;

c. a cylindrical weight module removably coupled to the weight-retaining structure of the body such that the weight module is entirely within the platform-supporting structure, wherein the weight module is accessible and separatable from the weight-retaining structure while a user is stepping on the platform surface and also directly above the body; and d. an accessory resistance device that includes a first handle and a second handle coupled together by a resilient strand, wherein the accessory interface comprises two elliptical apertures disposed on opposite faces of the body, and wherein the first handle and the second handle are configured to fit through apertures when aligned along major axes of the elliptical apertures, but not when aligned along minor axes of the elliptical apertures.

* * * * *